United States Patent [19]

Michno et al.

[11] Patent Number: 4,912,024

[45] Date of Patent: Mar. 27, 1990

[54] PHOTOGRAPHIC MATERIAL HAVING RELEASABLE COMPOUND

[75] Inventors: Drake M. Michno, Webster; Richard P. Szajewski, Rochester; Stephen P. Singer, Spencerport, all of N.Y.

[73] Assignee: Eastman Kodak Company, Rochester, N.Y.

[21] Appl. No.: 209,742

[22] Filed: Jun. 21, 1988

[51] Int. Cl.[4] ..... G03C 7/32; G03C 7/26

[52] U.S. Cl. ..... 430/544; 430/553; 430/555; 430/557; 430/558; 430/957

[58] Field of Search ..... 430/544, 553, 555, 557, 430/558, 957

[56] References Cited

U.S. PATENT DOCUMENTS

| | | | |
|---|---|---|---|
| 4,248,962 | 2/1981 | Lau | 430/382 |
| 4,293,691 | 10/1981 | Furutachi et al. | 544/140 |
| 4,409,323 | 10/1983 | Sato et al. | 430/544 |
| 4,812,389 | 3/1989 | Sakanoue et al. | 430/382 |

FOREIGN PATENT DOCUMENTS

| | | |
|---|---|---|
| 0193389 | 3/1986 | European Pat. Off. . |
| 149359 | 8/1984 | Japan . |
| 177548 | 8/1987 | Japan . |
| 070239 | 3/1988 | Japan . |
| 070851 | 3/1988 | Japan . |
| 070852 | 3/1988 | Japan . |
| 070853 | 3/1988 | Japan . |

*Primary Examiner*—Charles L. Bowers, Jr.
*Assistant Examiner*—Patrick A. Doody
*Attorney, Agent, or Firm*—Paul L. Marshall

[57] ABSTRACT

Photographic elements are disclosed having a first coupler represented by the formula:

$$COUP_1—T—INH—CH_2—Q$$

wherein $COUP_1$ is a coupler moiety,

T is a timing group that is bonded to the coupler moiety at a coupling position and that is cleaved from —INH—$CH_2$—Q after it is released from the coupler moiety upon exposure and processing of the element, and INH—$CH_2$—Q is a development inhibitor moiety wherein Q is a ballasting group, and a second coupler represented by the formula:

$$COUP_2—(TIME)_n—S—R_1—R_2$$

wherein $COUP_2$ is a coupler moiety, TIME is a timing group, n is 0 or 1, $R_1$ is a divalent linking group that does not include a heterocyclic ring attached directly to S, and $R_2$ is a water solubilizing group.

14 Claims, No Drawings

PHOTOGRAPHIC MATERIAL HAVING RELEASABLE COMPOUND

FIELD OF THE INVENTION

This invention relates to photographic materials and elements, specifically to materials and elements having a coupler that releases a development inhibitor compound and another coupler that releases another releasable compound.

BACKGROUND OF THE INVENTION

Development inhibitor releasing compounds or couplers (DIR's) are compounds that release development inhibitor compounds upon reaction with oxidized developer. DIR's are used in photographic materials to improve image sharpness (acutance), reduce gamma-normalized granularity (a measure of signal to noise ratio with a low gamma-normalized granularity indicating a beneficial high signal to noise ratio), control tone scale, and control color correction.

It is often desirable to maximize the amount of development inhibitor that is released in order to maximize the amount of sharpness and minimize the contrast-(gamma)-normalized granularity of the image produced in a photographic material. However, the amount of tone scale control and color correction control must usually be maintained within specific limits for visually pleasing image reproduction. This often limits the degree of sharpness and gamma-normalized granularity improvement that can be obtained through the use of DIR compounds.

This problem has been addressed in a number of ways. One way to increase image sharpness provided by a DIR compound is to increase the effective mobility of the released inhibitor compound by linking it to a coupler moiety through a timing group. Upon reaction with oxidized developer, the timing-inhibitor moiety is cleaved from the coupler moiety. The inhibitor moiety releases from the timing group and thus becomes active, but only after a delay during which the timing-inhibitor moiety could move in the material. The incorporation of such timing groups in DIR's and the advantages thereby achieved is described in U.S. Pat. Nos. 4,284,962 and 4,409,323. An example of such a timed DIR is:

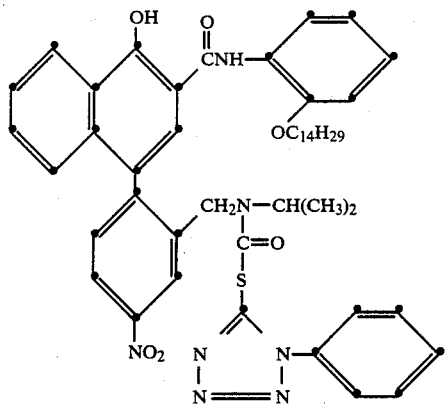

D-1

Another technique is to limit the amount of color correction, the so-called interimage effect, by utilizing a DIR that releases an inhibitor moiety that comprises a ballasting group enabling, upon exposure and processing of the material, reduced interlayer interimage effect without reduced image acutance. Such DIR's are described in the U.S. Patent Application entitled, "Photographic Materials and Process", filed concurrently herewith in the names of R. P. Szajewski, J. N. Poslusny, and W. K. Slusarek. These DIR's, however, do not provide reductions in gamma-normalized granularity to the extent that is often desirable.

It would therefore be highly desirable to provide a photographic material that offered the concommitant advantages of high image sharpness, low interlayer interimage effect, and low gamma-normalized granularity.

In an unrelated area, it has been taught to incorporate bleach accelerator-releasing compounds (BARC's) in photographic materials to aid in the bleaching step of photographic processing. European Patent Application Publication No. 193,389 discloses BARC's having a releasable thioether bonded to an alkylene group or heterocyclic nucleus with a solubilizing group attached thereto. One such BARC, having the formula:

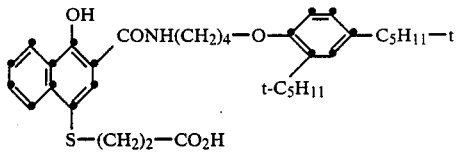

has been used as such in a color negative film, which also contained the above-identified DIR, D-1. This DIR does not have a $—CH_2—Q$ ballasting group. This combination, as shown below by comparative data, did not provide as great a reduction in gamma-normalized granularity (as compared to the DIR alone) as might be desired.

It has now been found that a specific subset of a class of compounds previously believed to be useful only as BARC's, allows for the incorporation of greater amounts of DIR's while maintaining the degree of color correction, and can provide the advantages of low interlayer interimage effect, high image sharpness, and low gamma-normalized granularity when used in combination with the above-described ballasted inhibitor-releasing compounds.

SUMMARY OF THE INVENTION

According to the present invention, there is provided a photographic element having at least one layer comprising a photographic silver halide emulsion. In reactive association with the emulsion is a first coupler (A) that is represented by the formula (I):

$$COUP_1—T—INH—CH_2—Q$$

wherein $COUP_1$ is a coupler moiety, T is a timing group that is bonded to the coupler moiety at a coupling position and that is cleaved from $—INH—CH_2—Q$ after it is released from the coupler moiety upon exposure and processing of the element, and $INH—CH_2—Q$ is a development inhibitor moiety wherein Q is a ballasting group. Also in reactive association with the emulsion is a second coupler (B) represented by the formula (II):

$$COUP_2—(TIME)_n—S—R_1—R_2$$

wherein $COUP_2$ is a coupler moiety, TIME is a timing group, n is 0 or 1, $R_1$ is a divalent linking group that does not include a heterocyclic ring attached directly to S, and $R_2$ is a water solubilizing group.

The combination of couplers (A) and (B) provides photographic elements with low interlayer interimage effect, high image sharpness, and low gamma-normalized granularity. When used with coupler (A), coupler (B) provides greater improvements in gamma-normalized granularity than when used with other DIR's.

DESCRIPTION OF THE PREFERRED EMBODIMENTS

A typical development inhibitor releasing coupler (A) as described is represented by the formula:

$$COUP_1—T—INH—CH_2—Q$$

wherein $COUP_1$ is a coupler moiety,

T is a timing group bonded to the coupler moiety at a coupling position and enabling timed release of —INH—$CH_2$—Q from the coupler moiety upon exposure and processing of the element, and INH—$CH_2$—Q is a development inhibitor moiety wherein Q is a ballasting group.

An illustrative coupler (A) as described is represented by the formula:

$$COUP_1—Nu—X—E—INH—CH_2—Q \quad (I)$$

wherein $COUP_1$ is a coupler moiety,

INH is a development inhibitor moiety containing at least one hetero atom,

Nu is a nucleophilic group attached to COUP at a position from which it is capable of being displaced as a result of reaction of COUP with oxidized color developing agent, X is a linking group spatially relating Nu and E, upon displacement of Nu from COUP, to undergo an intramolecular nucleophilic displacement reaction that cleaves the bond between INH and E, E is an electrophilic group attached to a hetero atom in INH, and $CH_2$—Q is as defined above.

Coupler (A), and specifically, the $CH_2$—Q moiety, enables reduced interlayer interimage effect without reduced acutance to be observed in a photographic silver halide element because the inhibitor moiety with $CH_2$—Q has reduced transportability in the structure of the photographic element and is also less absorbing to silver or silver halide than couplers without the $CH_2$—Q group. A highly preferred INH—$CH_2$—Q moiety that has the described characteristics is a 1-p-methoxybenzyl-5-mercapto-tetrazole moiety. This moiety has highly preferred transportability characteristics and is preferred in combination with a timing group (T) that also enables preferred transportability. Such a preferred moiety enables a lower degree of interimage effect and accordingly a lower degree of color correction. But also, this moiety enables an image that has a degree of acutance that is unexpectedly high. As a result the coupler (A) enables acutance enhancement as effective as other DIR couplers, for example those DIR couplers containing phenylmercaptotetrazole as an inhibitor moiety, but without the high interimage effects observed with those DIR couplers.

The most effective image is observed when the coupler moiety and the inhibitor moiety are separated by a group that enables timing of release of the inhibitor moiety from the carrier moiety during photographic processing. The reaction of coupler (A) with an oxidized color developing agent cleaves the bond between the carrier moiety and the timing group. Then, the bond between the timing group and the inhibitor moiety is cleaved by means of an intramolecular nucleophilic displacement reaction enabling the development inhibitor moiety to perform its intended function. Bond cleavage between the timing group and the inhibitor moiety does not involve the action of oxidized color developing agent.

A preferred coupler (A) is represented by formula (I) wherein $COUP_1$ is a coupler moiety. As used herein the terms "coupler" and "coupler compound" refer to the entire compound, including the coupler moiety, the timing group, and the inhibitor moiety, while the term "coupler moiety" refers to the portion of the compound other than the timing group and the inhibitor moiety.

The coupler moiety can be any moiety that will react with oxidized color developing agent to cleave the bond between the timing group and the coupler moiety. It includes coupler moieties employed in conventional color-forming couplers that yield colorless products, as well as coupler moieties that yield colored products on reaction with oxidized color developing agents. Both types of coupler moieties are known to those skilled in the photographic art.

The coupler moiety can be unballasted or ballasted with an oil-soluble or fat-tail group. It can be monomeric, or it can form part of a dimeric, oligomeric or polymeric coupler, in which case more than one INH group can be contained in the coupler, or it can form part of a bis compound in which the timing and inhibitor groups form part of the link between two coupler moieties.

It will be appreciated that, depending upon the particular coupler moiety, the particular color developing agent and the type of processing, the reaction product of the coupler moiety and oxidized color developing agent can be: (1) colored and nondiffusible, in which case it will remain in the location where it is formed; (2) colored and diffusible, in which case it may be removed during processing from the location where it is formed or allowed to migrate to a different location; or (3) colorless and diffusible or nondiffusible, in which case it will not contribute to image density. In cases (2) and (3) the reaction product may be initially colored and/or nondiffusible but converted to colorless and/or diffusible products during the course of processing.

The timing group, T, is joined to the coupler moiety at any of the positions from which groups released from couplers by reaction with oxidized color developing agent can be attached. Preferably, the timing group is attached at the coupling position of the coupler moiety so that upon reaction of the coupler with oxidized color developing agent the timing group will be displaced. However, the timing group can be attached to a non-coupling position of the coupler moiety from which it will be displaced as a result of reaction of the coupler with oxidized color developing agent. In the case where the timing group is at a non-coupling position of the coupler moiety, other groups can be in the coupling position, including conventional coupling-off groups or the same or different inhibitor moieties from that contained in the described inhibitor moiety of the invention. Alternatively, the coupler moiety can have a timing and inhibitor group at each of the coupling position and a non-coupling position. Accordingly, couplers of this invention can release more than one mole of inhibitor per mole of coupler. Each of these inhibitors can be the same or different and can be released at the same or different times and rates.

The timing group can be any organic group that will serve to connect $COUP_1$ to the inhibitor moiety and which, after cleavage from $COUP_1$, will cleave from the inhibitor moiety preferably by an intramolecular nucleophilic displacement reaction of the type described in, for example, U.S. Pat. No. 4,248,962 or by electron transfer down a conjugated chain as described in, for example, U.S. Pat. No. 4,409,323, the disclosures of which are incorporated herein by reference. Timing groups utilizing the mechanism in which there is electron transfer down a conjugated chain are especially preferred.

As used herein, the term "intramolecular nucleophilic displacement reaction" refers to a reaction in which a nucleophilic center of a compound reacts directly, or indirectly through an intervening molecule, at another site on the compound, which is an electrophilic center, to effect displacement of a group or atom attached to the electrophilic center. Such compounds have a nucleophilic group and electrophilic group spatially related by the configuration of the molecule to promote reactive proximity. Preferably the nucleophilic group and the electrophilic group are located in the compound so that a cyclic organic ring, or a transient cyclic organic ring, can be easily formed by an intramolecular reaction involving the nucleophilic center and the electrophilic center.

A useful illustrative class of timing group (T) is represented by the structure:

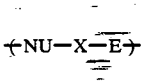

wherein:

Nu is a nucleophilic group attached to a position on $COUP_1$ from which it will be displaced upon reaction of $COUP_1$ with oxidized color developing agent, E is an electrophilic group attached to an inhibitor moiety as described and is displaceable therefrom by Nu after Nu is displaced from $COUP_1$, and X is a linking group for spatially relating Nu and E, upon displacement of Nu from $COUP_1$, to undergo an intramolecular nucleophilic displacement reaction with the formation of a 3- to 7-membered ring and thereby release $INH—R^1$.

A nucleophilic group (Nu) is understood to be a grouping of atoms one of which is electron rich. This atom is referred to as the nucleophilic center. An electrophilic group (E) is understood to be a grouping of atoms one of which is electron deficient. This atom is referred to as the electrophilic center.

In photographic couplers as described, the timing group can contain a nucleophilic group and an electrophilic group that are spatially related with respect to one another by a linking group (X) so that upon release from the coupler moiety, the nucleophilic center and the electrophilic center will react to effect displacement of the inhibitor moiety from the timing group. The nucleophilic center should be prevented from reacting with the electrophilic center until release from the coupler moiety and the electrophilic center should be resistant to external attack such as hydrolysis. Premature reaction can be prevented by attaching the coupler moiety to the timing group at the nucleophilic center or an atom in conjunction with a nucleophilic center, so that cleavage of the timing group and the inhibitor moiety from the coupler moiety unblocks the nucleophilic center and permits it to react with the electrophilic center, or by positioning the nucleophilic group and the electrophilic group so that they are prevented from coming into reactive proximity until release. The timing group can contain additional substituents, such as additional photographically useful groups (PUG), or precursors thereof, which may remain attached to the timing group or be released.

It should be understood that for an intramolecular reaction to occur between the nucleophilic group and the electrophilic group, the groups should be spatially related after cleavage from the coupler, so that they can react with one another. Preferably, the nucleophilic group and the electrophilic group are spatially related within the timing group so that the intramolecular nucleophilic displacement reaction involves the formation of a 3- to 7-membered ring, most preferably a 5- or 6-membered ring.

It should be further understood that for an intramolecular reaction to occur in the aqueous alkaline environment encountered during photographic processing, thereby displacing the timing group from the coupler moiety, the thermodynamics should be such and the groups be selected so that the free energy of ring closure plus the bond energy of the bond formed between the nucleophilic group and the electrophilic group is greater than the bond energy between the electrophilic group and other groups. Not all possible combinations of nucleophilic group, linking group, and electrophilic group will yield a thermodynamic relationship favorable to breaking of the bond between the electrophilic group and the inhibitor moiety; however, it is within the skill of the art to select appropriate combinations taking the above energy relationships into account.

Representative Nu groups contain electron rich oxygen, sulfur and nitrogen atoms. Representative E groups contain electron deficient carbonyl, thiocarbonyl, phosphonyl and thiophosphonyl moieties. Other useful Nu and E groups will be apparent to those skilled in the art.

In the following listings of representative Nu and E groups, the groups are oriented so that the lefthand bond of Nu is joined to $COUP_1$ and the righthand bond of Nu is joined to X, while the lefthand bond of E is joined to X and the righthand bond of E is joined to INH.

Representative Nu groups include:

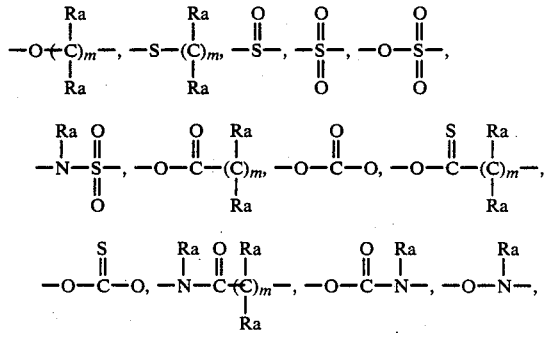

-continued and $-O-\overset{\overset{O}{\|}}{\underset{\underset{Ra}{|}}{P}}-\overset{\overset{Ra}{|}}{\underset{\underset{Ra}{|}}{(C)_m}}-$ where each Ra is independently hydrogen, alkyl, such as alkyl of 1 to 20 carbon atoms including substituted alkyl such as methyl, ethyl, propyl, hexyl, decyl, pentadecyl, octadecyl, carboxyethyl, hydroxypropyl, sulfonamidobutyl and the like, or aryl, such as aryl of 6 to 20 carbon atoms including substituted aryl such as phenyl, naphthyl, benzyl, tolyl, t-butylphenyl, carboxyphenyl, chlorophenyl, hydroxyphenyl and the like, and m is an integer from 0 to 4 such that the ring formed by Nu, X and E upon nucleophilic attack of Nu upon the electrophilic center in E contains 3 to 7 ring atoms. Preferably Ra is hydrogen, alkyl of 1 to 4 carbon atoms or aryl of 6 to 10 carbon atoms.

Representative E groups include:

$$\overset{\overset{Ra}{|}}{\underset{\underset{Ra}{|}}{(C)_m}}-\overset{\overset{O}{\|}}{C}-,\ -O-\overset{\overset{Ra}{|}}{\underset{\underset{Ra}{|}}{(C)_m}}-\overset{\overset{O}{\|}}{C}-,\ -S\overset{\overset{Ra}{|}}{\underset{\underset{Ra}{|}}{(C)_m}}-\overset{\overset{O}{\|}}{C}-,$$

$$-\overset{\overset{Ra}{|}}{\underset{\underset{Ra}{|}}{(C)_m}}-\overset{\overset{Ra}{|}}{N}-\overset{\overset{O}{\|}}{C}-,\ -O\overset{\overset{Ra}{|}}{\underset{\underset{Ra}{|}}{(C)_m}}-\overset{\overset{Ra}{|}}{N}-\overset{\overset{O}{\|}}{C}-,\ -S\overset{\overset{Ra}{|}}{\underset{\underset{Ra}{|}}{(C)_m}}-\overset{\overset{Ra}{|}}{N}-\overset{\overset{O}{\|}}{C}-,$$

$$-\overset{\overset{Ra}{|}}{\underset{\underset{Ra}{|}}{(C)_m}}-\overset{\overset{S}{\|}}{C}-,\ -O\overset{\overset{Ra}{|}}{\underset{\underset{Ra}{|}}{(C)_m}}-\overset{\overset{S}{\|}}{C}-,\ -S\overset{\overset{Ra}{|}}{\underset{\underset{Ra}{|}}{(C)_m}}-\overset{\overset{S}{\|}}{C}-,$$

$$-\overset{\overset{Ra}{|}}{\underset{\underset{Ra}{|}}{(C)_m}}-\overset{\overset{Ra}{|}}{N}-\overset{\overset{S}{\|}}{C}-,\ -O\overset{\overset{Ra}{|}}{\underset{\underset{Ra}{|}}{(C)_m}}-\overset{\overset{Ra}{|}}{N}-\overset{\overset{S}{\|}}{C}-,\ -S\overset{\overset{Ra}{|}}{\underset{\underset{Ra}{|}}{(C)_m}}-\overset{\overset{Ra}{|}}{N}-\overset{\overset{S}{\|}}{C}-,$$

$$-\overset{\overset{Ra}{|}}{\underset{\underset{Ra}{|}}{(C)_m}}-\overset{\overset{Ra}{|}}{\underset{\underset{Ra}{|}}{N}}-\overset{\overset{O}{\|}}{\underset{\underset{Ra}{|}}{P}}-,\ \text{and}\ -\overset{\overset{Ra}{|}}{\underset{\underset{Ra}{|}}{(C)_m}}-\overset{\overset{Ra}{|}}{\underset{\underset{Ra}{|}}{N}}-\overset{\overset{S}{\|}}{\underset{\underset{Ra}{|}}{P}}-$$

where Ra and m are as defined above.

E is preferably an electrophilic group selected from the group consisting of $$\overset{\overset{Rb}{|}}{\underset{\underset{Rb}{|}}{(C)_m}}\overset{\overset{O}{\|}}{C}-,\ \overset{\overset{Rb}{|}}{\underset{\underset{Rb}{|}}{(C)_m}}\overset{\overset{Rb}{|}}{N}-\overset{\overset{O}{\|}}{C}-,\ \overset{\overset{Rb}{|}}{\underset{\underset{Rb}{|}}{(C)_m}}\overset{\overset{S}{\|}}{C}-\ \text{and}\ \overset{\overset{Rb}{|}}{\underset{\underset{Rb}{|}}{(C)_m}}\overset{\overset{Rb}{|}}{N}-\overset{\overset{S}{\|}}{C}-$$

wherein each Rb is independently hydrogen, alkyl, such as alkyl containing 1 to 20 carbon atoms, preferably alkyl containing 1 to 4 carbon atoms, or aryl, such as aryl containing 6 to 20 carbon atoms, preferably aryl containing 6 to 10 carbon atoms; and m is 0 to 4, such that the ring formed upon reaction of the nucleophilic center in Nu with the electrophilic center in E contains 5- or 6-members.

The linking group represented by X can be an acyclic group such as alkylene, for example methylene, ethylene or propylene, or a cyclic group such as an aromatic group, such as phenylene or naphthylene, or a heterocyclic group, such as furan, thiophene, pyridine, quinoline or benzoxazine. Preferably X is alkylene or arylene. The groups Nu and E are attached to X to provide, upon release of Nu from COUP, favorable spatial relationship for nucleophilic attack of the nucleophilic center in Nu on the electrophilic center in E. When X is a cyclic group, Nu and E can be attached to the same or adjacent rings. Aromatic groups in which Nu and E are attached to adjacent ring positions are particularly preferred X groups.

X can be unsubstituted or substituted. The substituents can be those that will modify the rate of reaction, diffusion, or displacement, such as halogen, including fluoro, chloro, bromo, or iodo, nitro, alkyl of 1 to 20 carbon atoms, acyl, such as carboxy, carboxyalkyl, alkoxycarbonyl, alkoxycarbonamido, sulfoalkyl, alkylsulfonamido, and alkylsulfonyl, solubilizing groups, ballast groups and the like, or they can be substituents that are separately useful in the photographic element such as a stabilizer, an antifoggant, a dye (such as a filter dye, a solubilized masking dye) and the like. For example, solubilizing groups will increase the rate of diffusion; ballast groups will decrease the rate of diffusion; electron withdrawing groups will decrease the rate of displacement of the INH group.

As used herein, the term "electron transfer down a conjugated chain" is understood to refer to transfer of an electron along a chain of atoms in which alternate single bonds and double bonds occur. A conjugated chain is understood to have the same meaning as commonly used in organic chemistry. Electron transfer down a conjugated chain is as described in, for example, U.S. Pat. No. 4,409,323.

When the timing group T is of the type described in above-referenced U.S. Pat. No. 4,409,323, the timing group will be described herein as a "quinone-methide timing group". Examples of useful couplers as described comprising a quinone-methide timing group include:

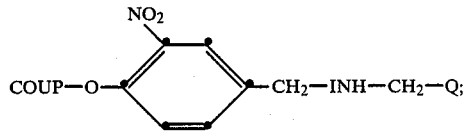

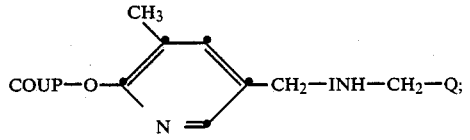

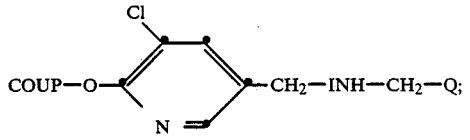

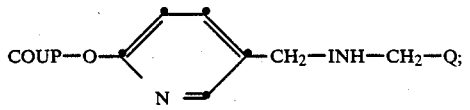

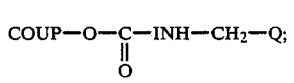

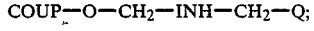

-continued

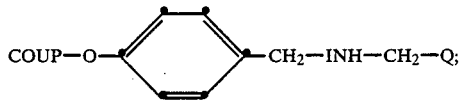

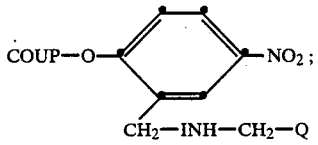

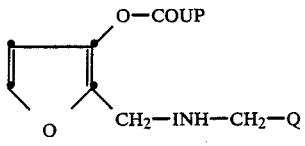

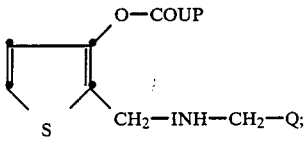

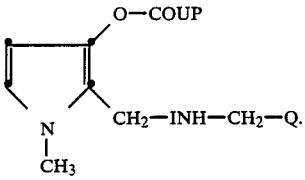

There follows a listing of patents and publications that describe representative useful $COUP_1$ groups. In these structures, Y represents —T—INH—$CH_2$—Q as described. In the case of dye-forming couplers that are useful with a coupler (A), the Y group represents hydrogen or a coupling-off group known in the photographic art.

I. COUP's

A. Couplers that form cyan dyes upon reaction with oxidized color developing agents are described in such representative patents and publications as: U.S. Pat. Nos. 2,772,162, 2,895,826, 3,002,836, 3,034,892, 2,474,293, 2,423,730, 2,367,531, 3,041,236 and "Farbkuppler-eine Literatureübersicht," published in Agfa Mitteilungen, Band III, pp. 156–175 (1961).

Preferably such couplers are phenols and naphthols that form cyan dyes on reaction with oxidized color developing agent and have the —Nu—X—E—INH coupling-off group attached at the coupling position, that is the carbon atom in the 4-position. Structures of such coupler moieties include:

IA-1

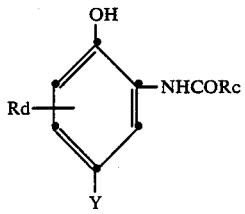

-continued

IA-2

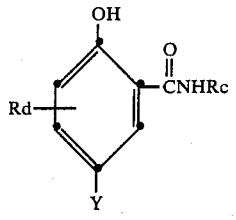

IA-3

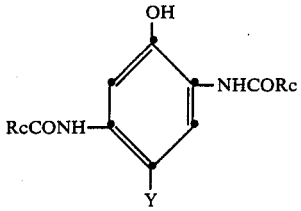

IA-4

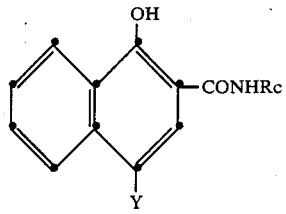

where Rc represents a ballast group, and Rd represents one or more halogen such as chloro or fluoro, lower alkyl containing 1 to 4 carbon atoms, such as methyl, ethyl, or butyl; or alkoxy containing 1 to 4 carbon atoms, such as methoxy, ethoxy, or butoxy groups.

B. Couplers that form magenta dyes upon reaction with oxidized color developing agent are described in such representative patents and publications as: U.S. Pat. Nos. 2,600,788, 2,369,489, 2,343,703, 2,311,082, 3,152,896, 3,519,429, 3,062,653, 2,908,573 and "Fabkuppler-eine Literatureübersicht," published in Agfa Mitteilungen, Band III, pp. 126–156 (1961).

Preferably, such couplers are pyrazolones, pyrazolotriazoles, or pyrazolobenzimidazoles that form magenta dyes upon reaction with oxidized color developing agents and have the Y attached to the coupling position. Structures of preferred such coupler moieties are:

IB-1

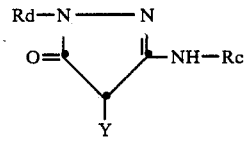

IB-2

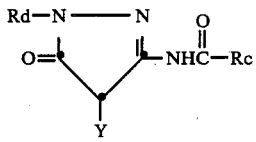

IB-3

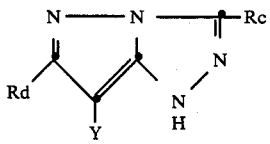

-continued

IB-4

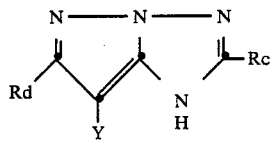

where Rc and Rd are chosen independently to be a ballast group, unsubstituted or substituted alkyl, unsubstituted or substituted phenyl.

C. Couplers that form yellow dyes upon reaction with oxidized and color developing agent are described in such representative patents and publications as: U.S. Pat. Nos. 2,875,057, 2,407,210, 3,265,506, 2,298,443, 3,048,194, 3,447,928 and "Farbkuppler-eine Literatureü bersicht," published in Agfa Mitteilungen, Band III, pp. 112–126 (1961).

Preferably such yellow-dye forming couplers are acylacetamides, such as benzoylacetanilides and have the Y group attached to the coupling position, that is the active methylene carbon atom.

Structures of preferred such coupler moieties are:

IC-1

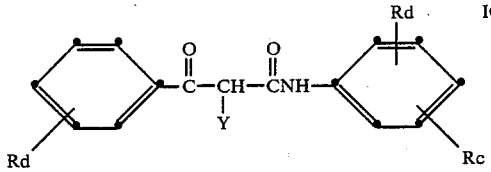

IC-2

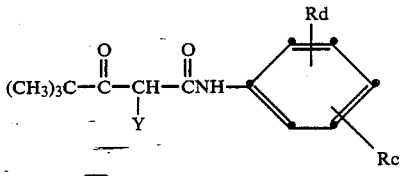

where Rc is as defined above and Rd and Re are hydrogen or one or more halogen, alkyl containing 1 to 4 carbon atoms, such as methyl and ethyl, or ballast groups, such as alkoxy of 16 to 20 carbon atoms.

D. Couplers that form colorless products upon reaction with oxidized color developing agent are described in such representative patents as: U.K. Pat. No. 861,138; U.S. Pat. Nos. 3,632,345, 3,928,041, 3,958,993 and 3,961,959. Preferably such couplers are cyclic carbonyl containing compounds that form colorless products on reaction with oxidized color developing agent and have the Y group attached to the carbon atom in the α-position with respect to the carbonyl group.

Structures of preferred such coupler moieties are:

ID-1

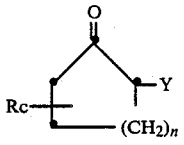

ID-2

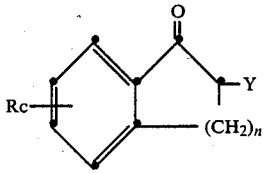

-continued

ID-3

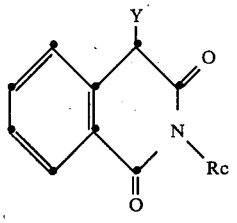

ID-4

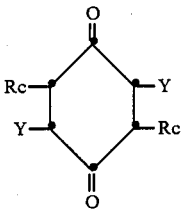

where Rc is as defined above and n is 1 or 2.

E. Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764.

Preferably such couplers are resorcinols or m-aminophenols that form black or neutral products on reaction with oxidized color developing agent and have the Y group para to a hydroxy group.

Structures of preferred such coupler moieties are:

IE-1

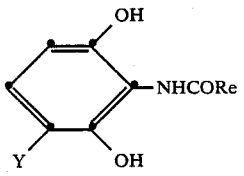

IE-2

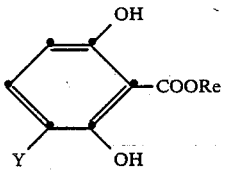

IE-3

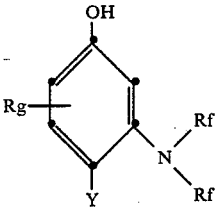

where Re is alkyl of 3 to 20 carbon atoms, phenyl or phenyl substituted with hydroxy, halo, amino, alkyl of 1 to 20 carbon atoms or alkoxy of 1 to 20 carbon atoms; each Rf is independently hydrogen, alkyl of 1 to 20 carbon atoms, alkenyl of 1 to 20 carbon atoms, or aryl of 6 to 20 carbon atoms; and Rg is one or more halogen, alkyl of 1 to 20 carbon atoms, alkoxy of 1 to 20 carbon atoms or other monovalent organic groups.

Examples of timing groups that enable an intramolecular nucleophilic displacement reaction are as follows:

A. Acyclic groups:

IIA-1

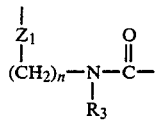

where n is 1–4, preferably 2 or 3, $Z_1$ is

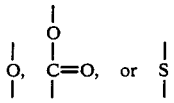

and $R_3$ is hydrogen, alkyl, such as alkyl of 1 to 20 carbon atoms, preferably alkyl of 1 to 4 carbon atoms, or aryl, such as aryl of 6 to 20 carbon atoms, preferably aryl of 6 to 10 carbon atoms.

B. Aromatic groups:

IIB-1

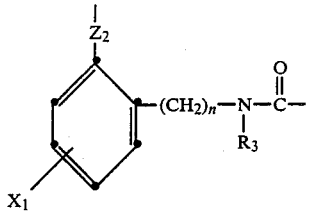

IIB-2

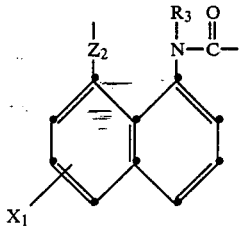

where n is 0 or 1; $Z_2$ is

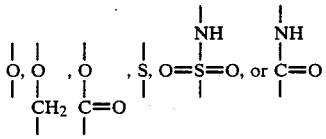

$R_3$ is hydrogen, alkyl, such as alkyl containing 1 to 30 carbon atoms, or aryl, such as phenyl and naphthyl; and $X_1$ is hydrogen or one or more substituent groups independently selected from cyano, fluoro, chloro, bromo, iodo, nitro, alkyl, such as alkyl of 1 to 20 carbon atoms, a dye, —$OR_4$, —$COOR_4$, —$CONHR_4$, —$NHCOR_4$, $NHSO_2R_4$, —$SO_2NHR_4$ of $SO_2R_4$, where $R_4$ is hydrogen, alkyl, such as alkyl of 1 to 20 carbon atoms, preferably alkyl of 1 to 4 carbon atoms, or aryl, such as aryl of 6 to 20 carbon atoms, preferably aryl of 6 to 10 carbon atoms.

C. Heterocyclic groups:

IIC-1

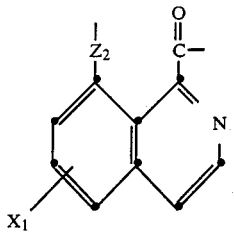

IIC-2

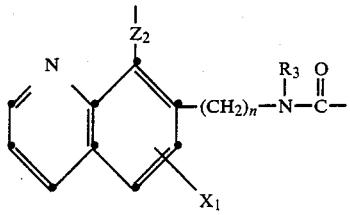

IIC-3

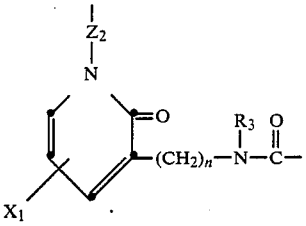

where n is 0 or 1, $Z_2$, $X_1$ and $R_3$ are as defined above.

D. Bis groups:

IID-1

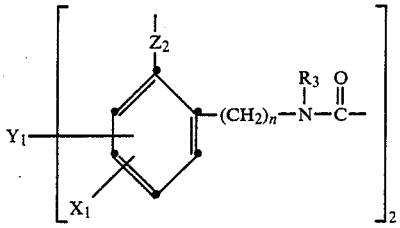

where $Y_1$ is a linking group, such as

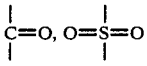

or —$NHSO_2CH_2SO_2NH$—; n is 0 or 1 and $X_1$, $Z_2$ and $R_3$ are as defined above.

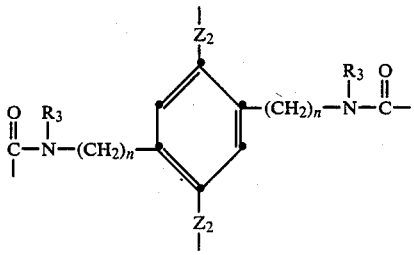

where n is 0 or 1 and $Z_2$, and $R_3$ are as defined above.

Such timing groups are described in, for example, U.S. Pat. No. 4,248,962.

Preferred development inhibitor groups (INH) are heterocyclic groups derived from such compounds as mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzotriazoles and benzodiazoles.

Typical examples of useful inhibitor groups (INH) are as follows. In each of the examples, $R^1$ represents the preferred point of attachment of the $—CH_2—Q$ group.

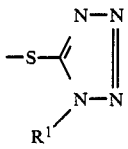

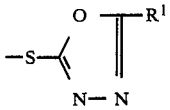

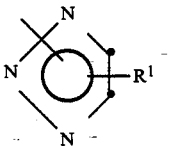

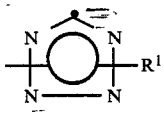

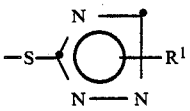

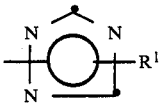

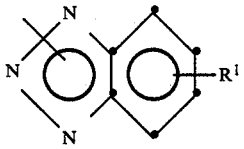

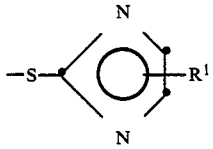

-continued

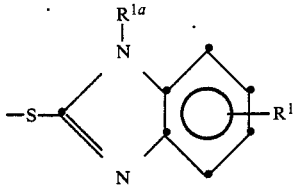

wherein $R^1a$ is hydrogen or an unsubstituted or substituted hydrocarbon group, such as methyl, ethyl, propyl, n-butyl, phenyl, or like $R_1$.

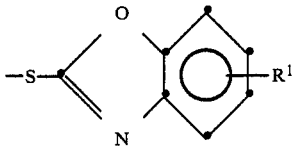

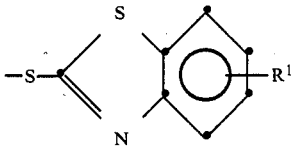

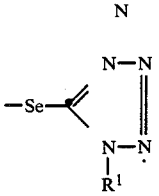

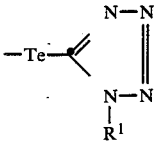

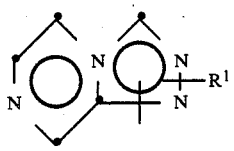

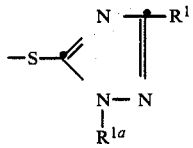

wherein $R^{1a}$ is hydrogen or an unsubstituted or substituted hydrocarbon group, such as methyl, ethyl, propyl, n-butyl, phenyl, or like $R_1$.

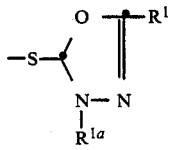

and

-continued

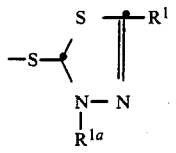

wherein $R^{1a}$ is hydrogen or an unsubstituted or substituted hydrocarbon group, such as methyl, ethyl, propyl, n-butyl, phenyl, or like $R_1$.

The inhibitor moiety can also be substituted with other groups that do not adversely affect the desired properties of INH.

Q is preferably a group that has a molecular weight greater than 70 mass units, contains no groups that are ionizable during photographic processing (photographic processing generally exposes the element to a pH of 9 or above), does not substantially decompose during processing, and contains at least one —C=C— or —C=N— double bond.

Examples of $—CH_2—Q$ include

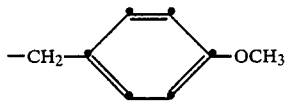

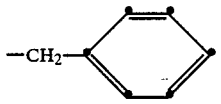

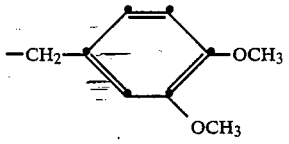

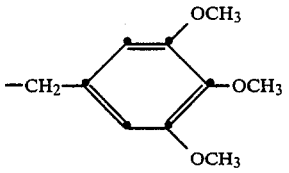

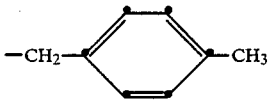

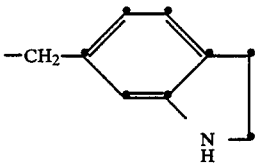

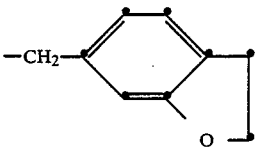

-continued

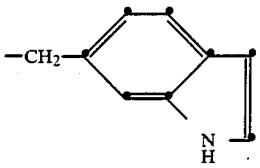

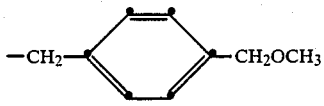

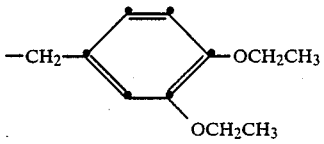

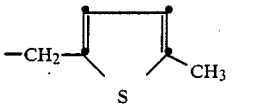

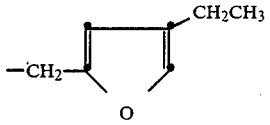

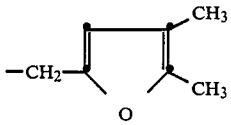

$—CH_2CH_2CH=CHBr$ $—CH_2—CH_2—CH=CH—CH=CH_2$

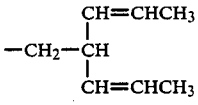

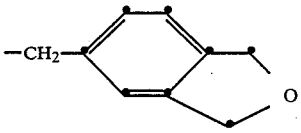

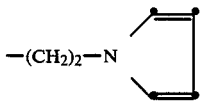

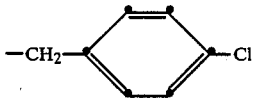

-continued

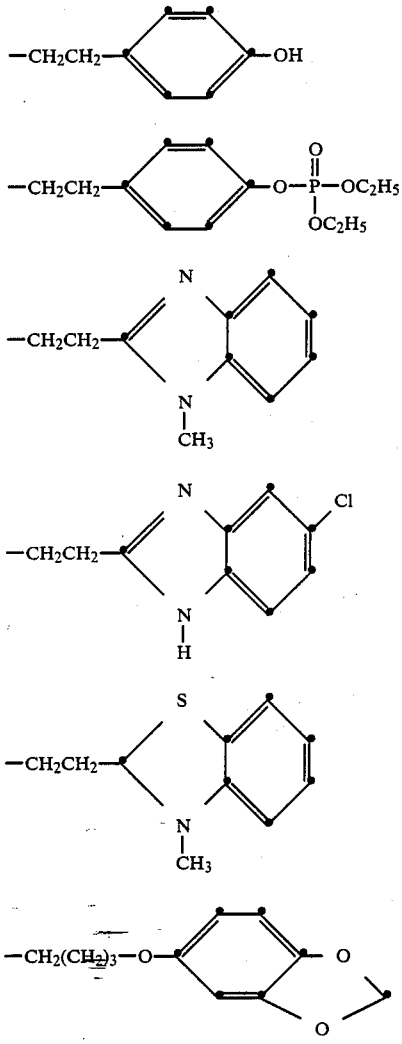

and others as described in the U.S. Patent Application entitled "Photographic Material Having Releasable Compound", filed concurrently herewith in the names of R. P. Szajewski, J. N. Poslusny, and W. K. Slusarek, the disclosure of which is incorporated herein by reference in its entirety.

The timing group T and INH are selected and prepared to adjust to the activity of the adjoining coupler moiety, and the other groups of the coupler in order to optimize release of the INH for its intended purpose. Accordingly, useful INH groups have differing structural types that enable timing groups having a range of activities. Various properties, such as pKa, are also usefully considered in optimizing the selection of optimum groups for a particular purpose. An example of such a selection could involve, for instance, a benzotriazole moiety as an inhibitor. Such a benzotriazole moiety can be released too quickly for some intended purposes from a timing group that involves an intramolecular nucleophilic displacement mechanism; however, the benzotriazole moiety can be modified as appropriate by substituent groups that change the rate of release.

Specific examples of coupler (A) are disclosed in the above-incorporated U.S. Patent Application entitled "Photographic Material Having Releasable Compound", filed concurrently herewith in the names of R. P. Szajewski, J. N. Poslusny, and W. K. Slusarek.

As to the coupler (B), the particular $R_1$ group linking the sulfur atom and the water solubilizing group $R_2$ can be varied to control such parameters as water solubility, diffusivity, silver affinity, silver ion complex solubility, silver development effects and other sensitometric effects. For example, $R_1$ can have more than one water solubilizing group, such as two carboxy groups. Since these parameters can be controlled by modification of $R_1$, they need not be emphasized in selecting a particular coupler moiety and the particular water solubilizing group, but provide freedom in selecting such moieties and groups for a particular photographic element and process.

In addition to yielding improvements in gamma-normalized granularity in combination with coupler (A), coupler (B) tends to reduce the development inhibiting effect of DIR compounds (this includes essentially all DIR compounds, not just those represented by the formula for coupler (A)). This effect can be used to advantage in a number of ways, depending on how the the various sensitometric properties of a photographic element are to be balanced. For example, the sharpness can be maintained while the amount of color correction can be reduced. Alternatively, greater amounts of DIR couplers can be used in a photographic element while maintaining the degree of color correction and tone control, so that improvements in image sharpness can be obtained. Also, desirable tone scale can be obtained while incorporating smaller quantities of silver halide, providing a more economical use of silver halide and improved image sharpness in the photographic element.

Other effects that coupler (B) can have are to reduce the susceptibility of the layer containing coupler (B) to development inhibitors released from other layers, thereby reducing interlayer interimage effects. Depending on the requirements of the photographic system, this can be highly desirable. Additionally, coupler (B) tends to increase the amount of dye formed from all couplers in the layer it is in, relative to the amount of silver developed, thereby increasing overall dye image efficiency.

In processing, the —S—$R_1$—$R_2$ fragment is released at an appropriate time as a unit. That is, —S—$R_1$—$R_2$ is released as a unit. The rate and total time of diffusion of the —S—$R_1$—$R_2$ fragment in the photographic element must be such as to enable, when used in combination with coupler (A), improvements in acutance and/or gamma-normalized granularity in the appropriate layers of the photographic element during processing. The timing group, when present, also releases —S—$R_1$—$R_2$ as a unit. Selection of $R_1$ and $R_2$ can also influence the rate and total time of release of the —S—$R_1$—$R_2$ moiety from the remainder of the compound, preferably the remainder of the coupler. It is preferable that the —S—$R_1$—$R_2$ moiety not adversely affect the processing steps and the photographic element.

Preferred photographic couplers of the invention are represented by the formula:

$$\mathrm{COUP_2{-}S{-}\underset{\underset{R^4}{|}}{\overset{\overset{R_3}{|}}{(C)}}_m{-}COOH}$$

wherein $COUP_2$ is as defined above;

m is 1 to 8;

$R_3$ and $R_4$ are individually hydrogen or alkyl containing 1 to 4 carbon atoms; and wherein the total number of carbon atoms in

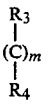

is 1 to 8. Alkyl includes straight or branched chain alkyl, such as methyl, ethyl, n-propyl, i-propyl, n-butyl, and t-butyl.

The $COUP_2$ coupler moiety of formula (II) can be any moiety as described above with respect to $COUP_1$, except of of course, that for $COUP_2$, Y would represent $—S—R_1—R_2$. The $—S—R_1—R_2$ moiety is attached at the coupling position of the coupler moiety that enables the $—S—R_1—R_2$ moiety to be displaced upon reaction of the coupler with oxidized color developing agent.

In $—S—R_1—R_2$ releasing couplers, the $—S—R_1—R_2$ moiety can be bonded to the remainder of the organic compound through a timing group (TIME). TIME in the described structures is a group that enables the timed release of $—S—R_1—R_2$ from COUP. The timing mechanism can be any timing mechanism that is useful for releasing photographically useful groups from coupler moieties. For example, the timing mechanism can be as described in, for example, U.S. Pat. Nos. 4,248,962 or 4,409,323, or German OLS 3,319,428.

Release of the $—S—R_1—R_2$ moiety can involve a single reaction or it can involve sequential reactions. For example, two or more sequential reactions may be required within a TIME group to effect release of the $—S—R_1—R_2$ moiety. As another example, the TIME group can have two $—S—R_1—R_2$ moieties bonded to different locations on the TIME group so that upon release of the TIME group from the coupler moiety, two reactions can occur sequentially enabling sequential release of the two $—S—R_1—R_2$ moieties. Another example is a reaction in which the TIME group may release a second coupler moiety that contains another timing group to which a photographically useful group is attached and from which it is released after the second coupler moiety reacts with oxidized color developing agent.

The TIME group can contain moieties and substituents that will permit control of one or more of the rates of reaction of COUP with oxidized color developing agent, the rate of diffusion of $—TIME—S—R_1—R_2$ once it is released from COUP and the rate of release of $—S—R_1—R_2$. The TIME group can contain added substituents, such as added photographically useful groups, that can remain attached to the timing group and be released independently. The TIME groups can contain a ballast group.

The water-solubilizing groups useful as $R_2$ are groups well-known in the art that tend to increase or enhance the water solubility of organic compounds. $R_2$ can optionally be a precursor to a water solubilizing group. For example, $R_2$ can be an ester group, which upon hydrolysis forms a water solubilizing carboxylic acid group.

The following $R_2$ groups are examples of useful water solubilizing groups and their precursors:

$—COOH$ $—COOCH_3$ $—COOC_2H_5$ $—NHSO_2CH_3$ $—SO_3H$ $—OH$

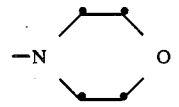

$—SO_2NHCH_3$

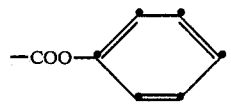

$—SO_2NH_2$ $—NR_5R_6$ wherein $R_5$ is H or alkyl of 1 to 4 carbons, $R_6$ is alkyl of 1 to 4 carbons and wherein at least one of $R_5$ and $R_6$ is alkyl, and the total carbon atoms in $R_5$ and $R_6$ is no more than 8.

The following are examples of useful $R_1$ groups:

$—CH_2—$ $—CH_2CH_2—$ $—CH_2CH_2CH_2—$

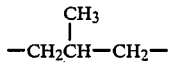

$—CH_2CH_2CH_2CH_2—$

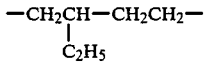

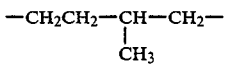

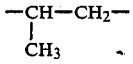

$—CH_2CH_2OCH_2CH_2—$

Examples of $—R_1—R_2$ moieties include $—CH_2—CH_2—CO_2H$, $—CH_2—CH_2—O—CH_2—CH_2—OH$,

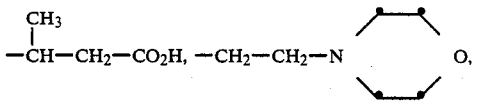

$—CH_2CH_2N(CH_3)_2$

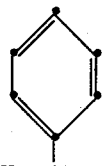

$—CH_2CO_2H$, $—CH(CH_3)—CH(CH_3)—CO_2H$, $—(CH_2)_4CO_2H$, $—CHCO_2H$,

-continued

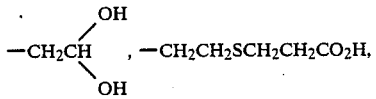

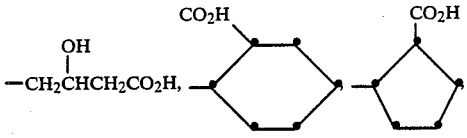

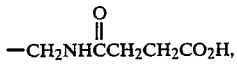

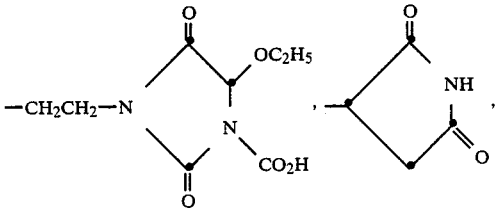

and $CH_2CH_2SO_3H$

TIME groups that are useful enable release of the —S—$R_1$—$R_2$ moiety at the appropriate time during processing, that is at the time that enables, when used in combination with coupler (A), improvements in acutance and/or gamma-normalized granularity in the appropriate layers of the photographic element during processing. Examples of such TIME groups include:

A. Acyclic TIME groups:

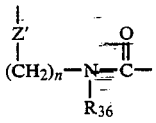

wherein n is 1 to 4;

Z′ is

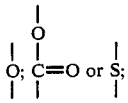

$R_{36}$ is hydrogen, alkyl, such as alkyl containing 1 to 20 carbon atoms; or aryl, such as aryl containing 6 to 20 carbon atoms, preferably unsubstituted phenyl or substituted phenyl.

B. Aromatic TIME groups:

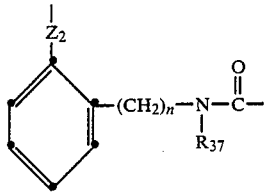

X wherein n is 0 or 1;

$Z_2$ is

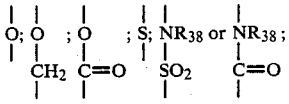

$R_{37}$ is hydrogen, alkyl, such as alkyl containing 1 to 20 carbon atoms; or aryl, such as aryl containing 6 to 20 carbon atoms, for example, phenyl;

$R_{38}$ is hydrogen, alkyl, such as alkyl containing 1 to 6 carbon atoms; or aryl, such as aryl containing 6 to 12 carbon atoms;

X is hydrogen; cyano; fluoro; chloro; bromo; iodo; nitro; alkyl, such as alkyl containing 1 to 20 carbon atoms; preferably methyl, ethyl, propyl or butyl; or aryl, such as aryl containing 6 to 20 carbon atoms, preferably unsubstituted phenyl or substituted phenyl.

Examples of specific couplers useful as coupler (B) include the following:

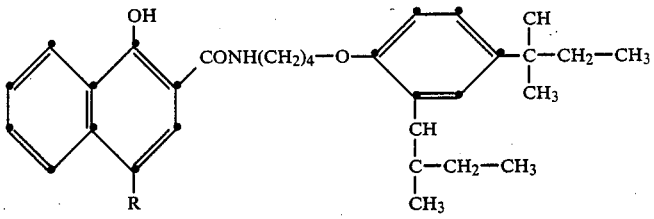

R = —S—$CH_2CH_2CO_2H$ B-1

B-2

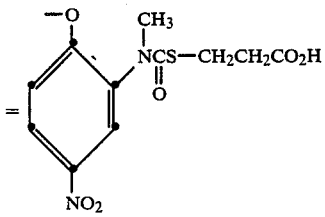

-continued
B-3
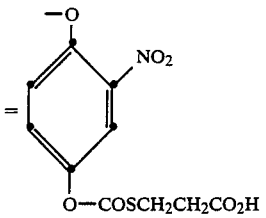
B-4
$= -S-CH(CH_3)CH_2CO_2H$
B-5
$= -S-CH_2CH_2OCH_2CH_2OH$
B-6
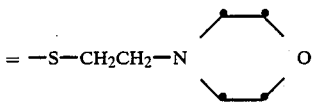
B-7
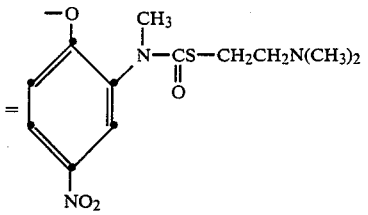
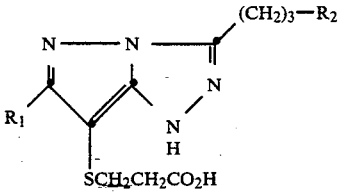
B-8
$R_1 = -CH_3$; $R_2 =$ 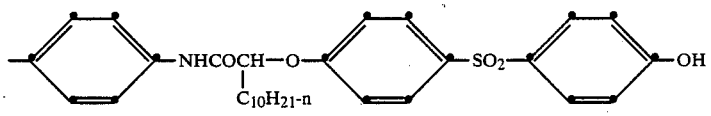
B-9
$R_1 = CH_3O-$ 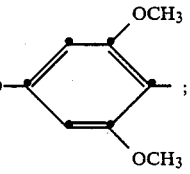 ; $R_2 = -O-$ 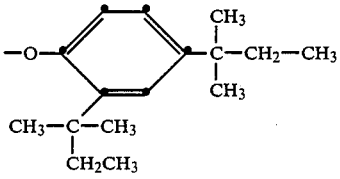
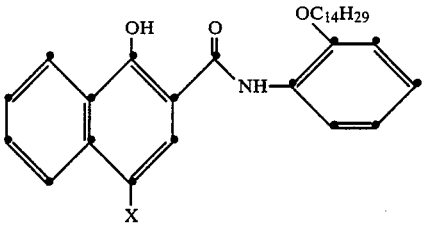
B-10
$X = S-CH_2-CH_2-CO_2H$
B-11
$X = S-CH_2-CO_2H$
B-12
$X = -O-C(=O)-S-CH_2-CH_2-CO_2H$ -continued
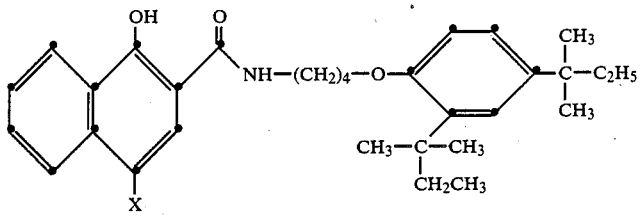
X = S—$CH_2$—$CO_2H$ B-13
X = 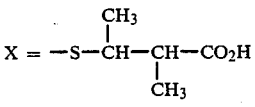 B-14
X = 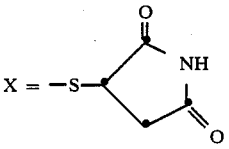 B-15
X = 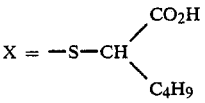 B-16
X = S—$(CH_2)_4$—$CO_2H$ B-17
X = 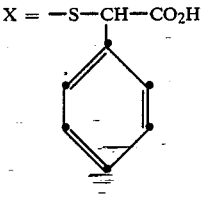 B-18
X = 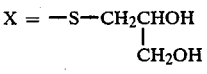 B-19
X = —S—$CH_2$—$CH_2$—O—$CH_2$—$CH_2$—$CO_2H$ B-20
X = 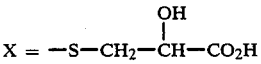 B-21
X = 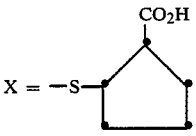 B-22
X = 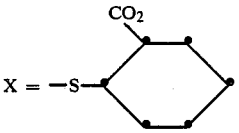 B-23
X = 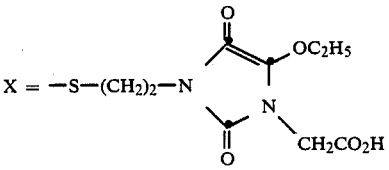 B-24

-continued
B-25
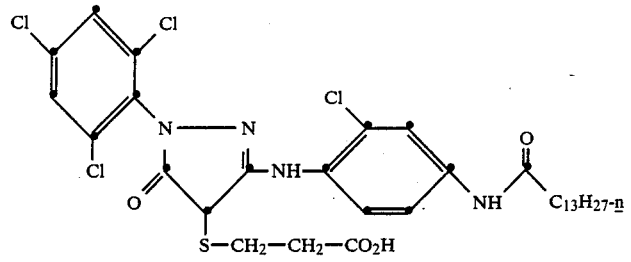
B-26
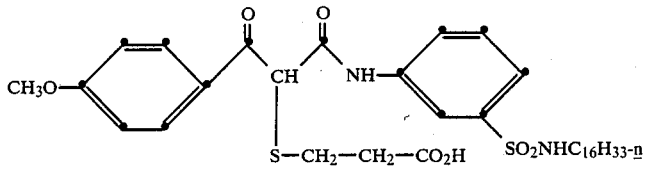
B-27
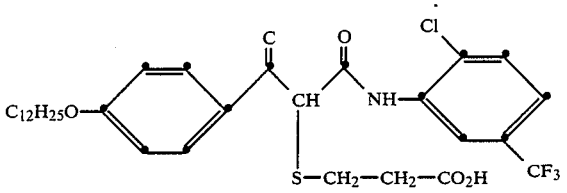
B-28
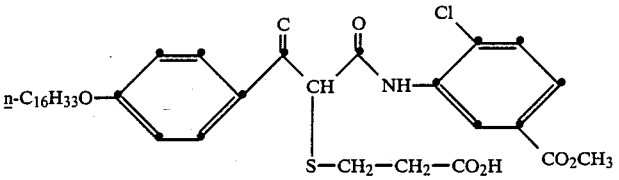
B-29
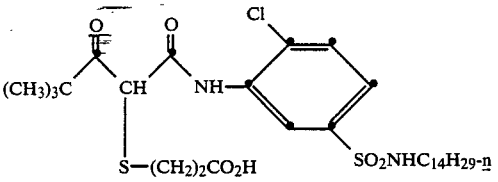
B-30
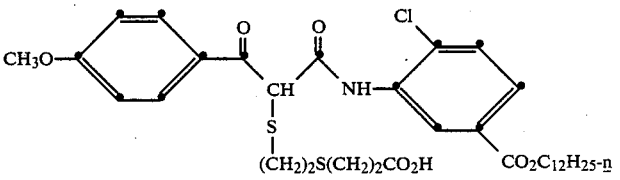
B-31
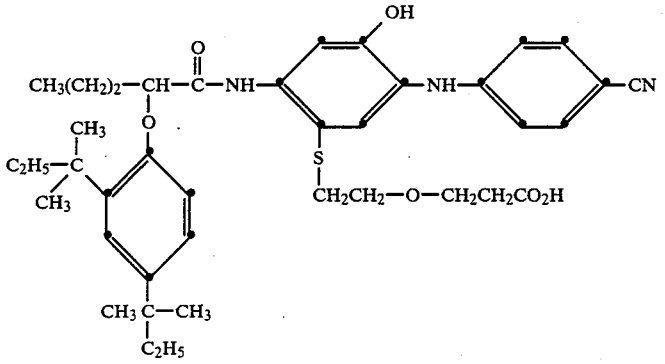

-continued

B-32

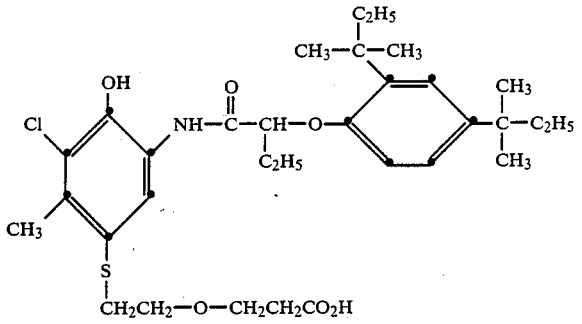

B-33

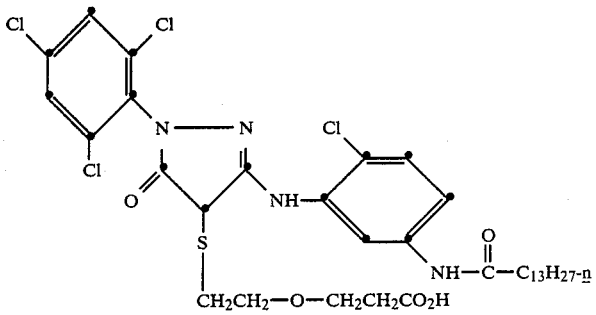

B-34

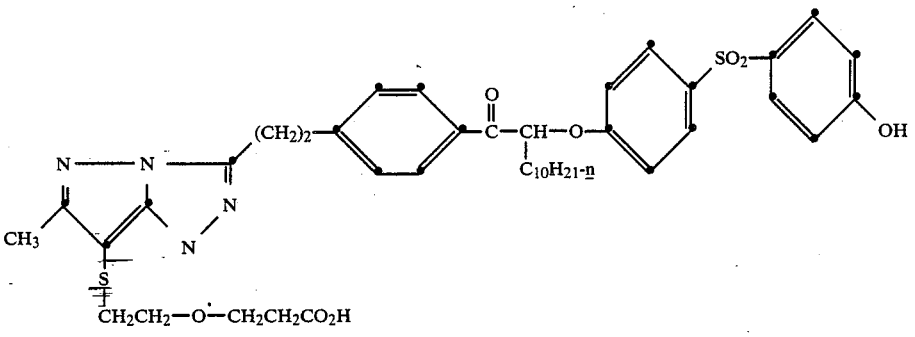

B-35

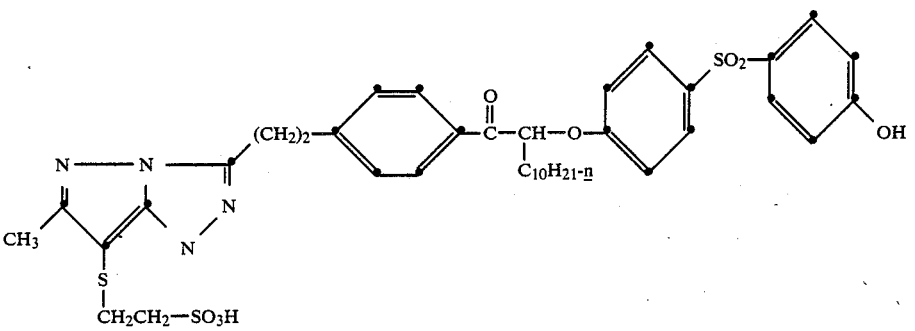

Couplers as described herein can be prepared by methods known in the organic compound synthesis art. A typical synthesis involves first attaching the timing group (if any) to the appropriate coupler moiety, or a derivative of the coupler moiety. The product is then reacted with an appropriate derivative of the inhibitor to form the desired coupler. Known reactions are employed to perform these steps. The following synthesis examples illustrate the way in which these steps can be performed using specific reactants and reactions.

SYNTHESIS EXAMPLE 1

This relates to the synthesis of the (B) coupler B-1:

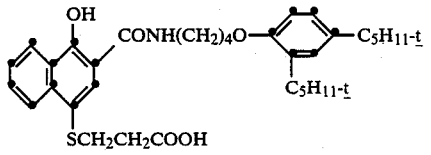

To a solution of 5 g (9.9 mmol) of the coupler moiety:

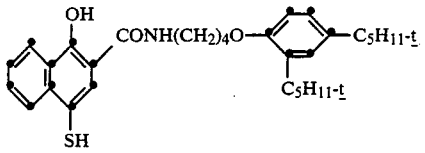

in 75 mL of tetrahydrofuran, stirred under nitrogen, is added 1.4 g (9.9 mmol) of tetramethylguanidine and then 1.1 mL (9.9 mmol) of ethyl acrylate. After 30 minutes 50 mL of methanol and 10 mL of 1.25N sodium hydroxide solution are added and the resulting composition stirred for 15 minutes. The mixture is then drowned in ice-cold dilute hydrochloric acid. The desired product is extracted and purified. For example, the desired product is extracted with diethyl ether to obtain, after crystallization, the desired coupler, which is a colorless solid having a melting point of 139° C. to 141° C. The product is also identified by elemental and spectral analysis.

SYNTHESIS EXAMPLE 2

This relates to the synthesis of the (A) coupler A-1:

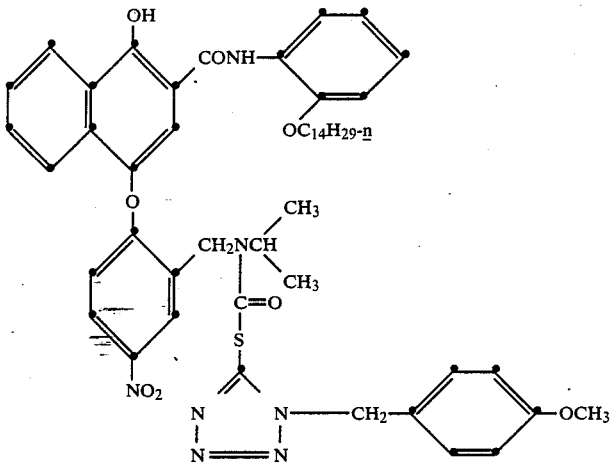

A. Preparation of 1-(p-Methoxybenzyl)tetrazoline-5-thione (S-4), also named as methoxylbenzylmercaptotetrazole.

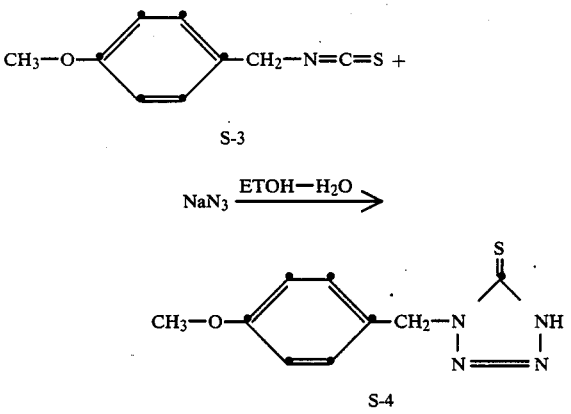

To a mechanically stirred slurry of 112 g (0.625 mole) 4-methoxylbenzylisothiocyanate (S-3) in 800 ml ethanol under a nitrogen atmosphere was added in a slow stream 81.3 g (1.25 mole) sodium azide dissolved in 400 ml water. The resulting reaction mixture was refluxed for 16 hours, cooled to room temperature (20° C.) and filtered. The filtrate was extracted twice with ether, and then acidified to pH=1 with concentrated hydrochloric acid. The resulting precipitate was filtered off and recrystallized from ethyl acetate-hexane to yield 20 g of a white solid S-4 m.p. 162°-4° C.

B. Preparation of Carbamoyl Chloride Intermediate S-6

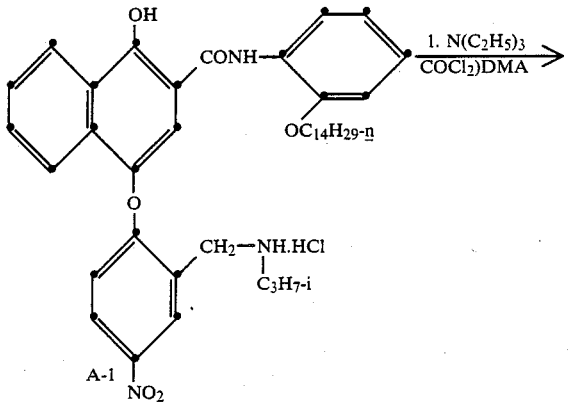

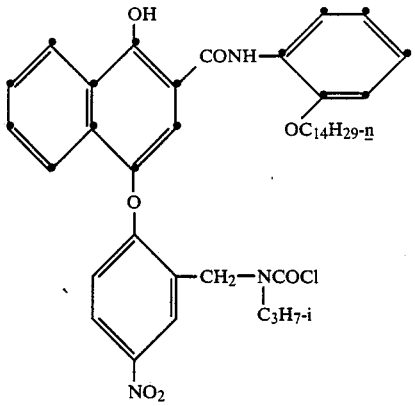

A slurry of S-5 amine hydrochloride (38.8 g, 0.054 mole) and triethylamine (5.45 g, 0.054 mole) in 300 ml dry tetrahydrofuran was stirred at room temperature (20° C.) under a nitrogen atmosphere for one hour and then filtered, N,N-dimethylaniline (9.1 g, 0.075 mole) was added to the filtrate and the resulting mixture added dropwise to 100 ml of a stirred 12% phosgene in toluene solution. The reaction was cooled in an ice-acetone bath under a nitrogen atmosphere.

After one hour, the reaction mixture was filtered and the filtrate concentrated in vacuo and the resulting gum (S-6) used directly in the next reaction.

C. Preparation of the coupler

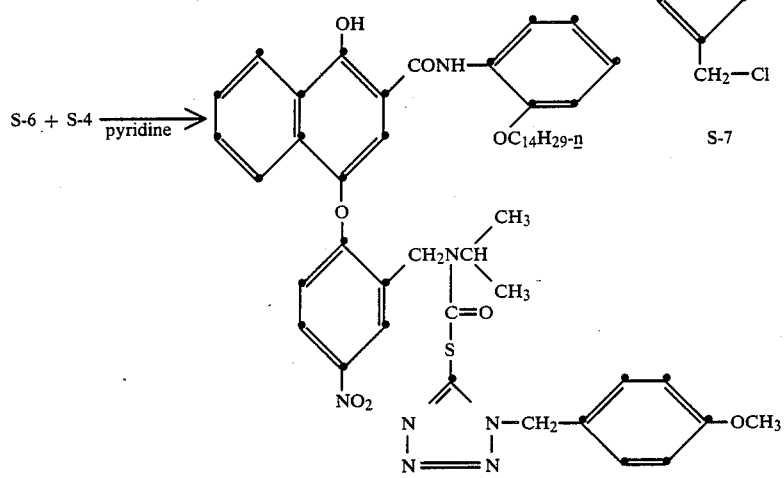

To a room temperature solution of S-4 carbamoyl chloride, (S-6) (≈0.054 mole from previous reaction) in 250 ml pyridine was added in one portion 12 g (0.054 mole) of 4-methoxybenzylmercaptotetrazole (S-4) and the resulting solution stirred for fifteen hours under a nitrogen atmosphere.

The reaction mixture was then quenched in ca. 1.5 l ice-water mixture containing 250 ml concentrated hydrochloric acid. This mixture was extracted with ethyl acetate (3×). The combined extracts were washed with 5% hydrochloric acid (2×), water (2×), brine, dried over anhydrous magnesium sulfate, filtered, and evaporated in vacuo. After chromatography over silica gel (cyclohexane-ethyl acetate)—the product containing fractions were combined, evaporated in vacuo, and the resulting gum crystallized from hexane-ethyl acetate to yield 6 g compound as an off-white solid, m.p. 92°-5° C. The elemental analysis was correct for the indicated structure.

Calculated: C, 65.7; H, 6.55; N, 10.5; S, 3.4; Found: C, 65.1; H, 6.50; N, 10.4; S, 3.6.

SYNTHESIS EXAMPLE 3

This example relates to the synthesis of an (A) coupler A-2.

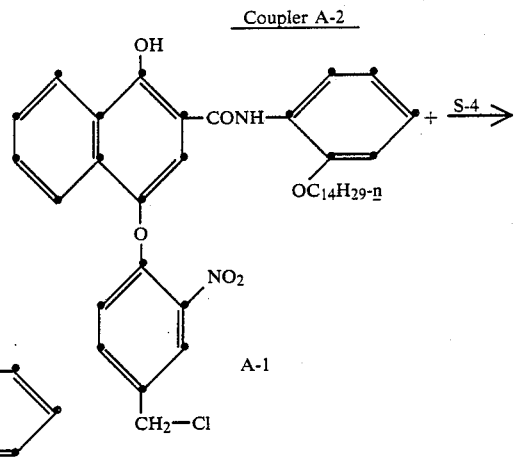

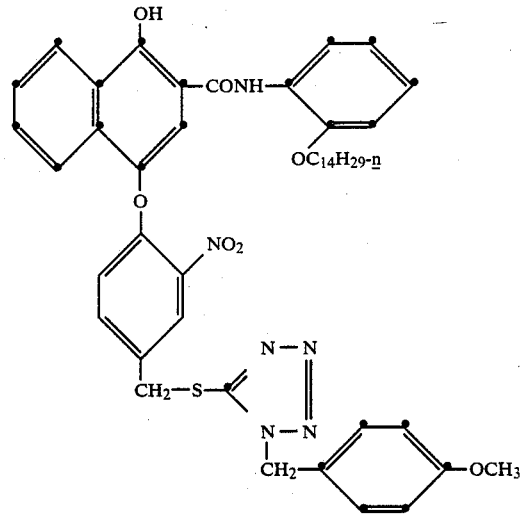

A mixture of 6.6 g (10 mmole) benzyl chloride (S-7), 2.2 g (10 mmole) 4-methoxybenzyl mercaptotetrazole (S-2), 0.84 g, (10 mmole) sodium bicarbonate, and 0.05 g tetrabutylammonium bromide in 50 ml dichloromethane and 30 ml water was stirred at room temperature for 18 hours at which time an additional 0.44 g (S-4 and 0.12 g sodium bicarbonate was added. After four more hours, the organic layer was separated, dried over anhydrous magnesium sulfate, filtered, and concentrated in vacuo. The resulting oil was chromatographed over silica (dichloromethane) and the product-containing eluants were combined and concentrated in vacuo to yield an oil which was crystallized from acetic acid to yield 3.0 g of the desired product, m.p. 75°-6° C. The elemental analysis was correct for structure indicated.

Calculated: C, 66.6; H, 6.4; N, 9.9; S, 3.8; Found: C, 66.7; H, 6.7; N, 9.9; S, 3.6.

Additional examples of the synthesis of (A) couplers can be found in the above-referenced U.S. Patent Application entitled "Photographic Material Having Releasable Compound", filed concurrently herewith in the names of R. P. Szajewski, J. N. Poslusny, and W. K. Slusarek. Additional synthesis examples of (B) couplers can be found in European Patent Application Publication No. 193,389, the disclosure of which is incorporated herein by reference.

The couplers described herein can be incorporated in photographic elements and/or in photographic processing solutions, such as developer solutions, so that upon development of an exposed photographic element they will be in reactive association with oxidized color developing agent and each other. Coupler compounds incorporated in photographic processing solutions should be of such molecular size and configuration that they will diffuse through photographic layers with the processing solution. When incorporated in a photographic element, as a general rule, the coupler compounds should be nondiffusible, i.e., they should be of such molecular size and configuration or physical form that they will not significantly diffuse or wander from the layer in which they are coated.

Photographic elements as described can be processed by conventional techniques in which color forming couplers and color developing agents are incorporated in separate processing solutions or compositions or in the element.

Photographic elements in which the coupler (A) is incorporated can be a simple element comprising a support and a single silver halide emulsion layer or they can be multilayer, multicolor elements. The coupler (A) can be incorporated in at least one of the silver halide emulsion layers and/or in at least one other layer, such as an adjacent layer, where it will come into reactive association with oxidized color developing agent that has developed silver halide in the emulsion layer. The coupler (B) can be in the same layer as the coupler (A) or in a different layer, such as an adjacent layer, so that the two couplers are in reactive association with each other during processing.

The silver halide emulsion layer can contain or have associated with it, other couplers, such as dye-forming couplers, colored masking couplers, and/or competing couplers. These other photographic couplers can form dyes of the same or different color and hue as the photographic couplers of this invention. Additionally, the silver halide emulsion layers and other layers of the photographic element can contain addenda conventionally contained in such layers.

A typical multilayer, multicolor photographic element as described can comprise a support having thereon a red-sensitive silver halide emulsion unit having associated therewith a cyan dye image providing material, a green-sensitive silver halide emulsion unit having associated therewith a magenta dye image providing material and a blue-sensitive silver halide emulsion unit having associated therewith a yellow dye image-providing material, at least one of the silver halide emulsion units having associated therewith couplers (A) and (B) as described. Each silver halide emulsion unit can be composed of one or more layers and the various units and layers can be arranged in different locations with respect to one another.

If $COUP_1$, T, INH, $COUP_2$, TIME, and/or —S—$R_1$—$R_2$ are diffusible moieties, the layer or unit affected by INH and/or —S—$R_1$—$R_2$ can be controlled by incorporating in appropriate locations in the element a scavenger layer that will confine the action of $COUP_1$, T, INH, $COUP_2$, TIME, and/or —S—$R_1$—$R_2$ to the desired layer or unit. At least one of the layers of the photographic element can be, for example, a mordant layer or a barrier layer.

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the silver halide grains. They can be chemically and spectrally sensitized. Examples of emulsions and their preparation are described in *Research Disclosure*, Item 17643, December, 1978 [hereinafter *Research Disclosure I*]. The emulsions typically will be gelatin emulsions although other hydrophilic colloids are useful, as described in *Research Disclosure I*. Tabular grain light sensitive silver halides are particularly useful such as described in *Research Disclosure*, January 1983, Item No. 22534 and U.S. Pat. No. 4,434,226.

The support can be any support used with photographic elements, as described in *Research Disclosure I*. Typical supports include cellulose nitrate film, cellulose acetate film, polyvinylacetal film, polyethylene terephthalate film, polycarbonate film and related films or resinous materials as well as glass, paper, metal and the like. Generally, a flexible support is employed, such as a polymeric film or paper support. Paper supports can be acetylated or cated with baryta and/or an α-olefin polymer, particularly a polymer of an α-olefin containing 2 to 10 carbon atoms such as polyethylene, polypropylene, ethylene-butene copolymers, and the like.

The photographic elements of this invention or individual layers thereof, can contain brighteners (see *Research Disclosure I*, Section V), antifoggants and stabilizers (see *Research Disclosure I*, Section VI), antistain agents and image dye stabilizer (see *Research Disclosure I*, Section VII, paragraphs I and J), light absorbing and scattering materials (see *Research Disclosure I*, Section VIII), matting agents (see *Research Disclosure I*, Section XVI) and development modifiers (see *Research Disclosure I*, Section XXI).

Photographic elements can be exposed to actinic radiation, usually in the visible region of the spectrum, to form a latent image as described in *Research Disclosure I*, Section XVIII and then processed to form a visible dye image as described in *Research Disclosure I*, Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N- -(methanesulfonamido) ethylaniline sulfate hydrate, 4-amino-3-methyl-N-ethyl-N- -hydroxyethylaniline sulfate, 4-amino-3-- -(methanesulfonamido)ethyl-N,N-diethylaniline hydrochloride and 4-amino-N-ethyl-N-(2-methoxyethyl)-m-toluidine di-p-toluene sulfonic acid.

With negative working silver halide a negative image can be formed. Optionally positive (or reversal) image can be formed.

Development is followed by the conventional steps of bleaching, fixing, or bleach-fixing, to remove silver and silver halide, washing and drying.

The following examples further illustrate the invention.

Coupler (A) can be used in photographic elements in the same way as photographic couplers that release inhibitors have previously been used in photographic elements.

Depending upon the nature of the particular INH, the coupler (A) (and coupler (B)) can be incorporated in a photographic element for different purposes and in different locations.

The range of operation between layers of the moieties released from the couplers as described can be controlled by the use of scavenger layers, such as a layer of fine grain silver halide emulsion. Scavenger layers can be in various locations in an element containing couplers as described. They can be located between layers, between the layers and the support, or over all of the layers.

The invention is further illustrated by the following examples:

EXAMPLES 1-2

Photographic elements were prepared according to the following format:

| |
|---|
| gelatin (500 mg/ft$^2$) |
| bisvinlysulfonylmethyl ether (1.75% of total gel) |
| dye-forming coupler* (at level indicated in Table I) |
| DIR coupler as indicated in Table I |
| coupler (B) as described in Table I |
| AgI (6.4%)Br(93.6%) (150 mg/ft$^2$) |
| gelatin (350 mg/ft$^2$) |
| support |

-continued

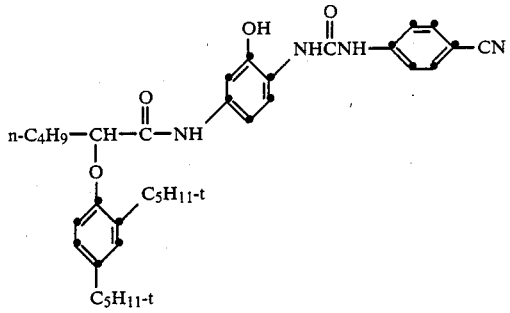

The elements were exposed through a graduated test object to simulated daylight and processed as follows:

| | |
|---|---|
| Pre-Bath (pH 9.26 buffer) | 10 s |
| Wash | 5 s |
| Color Developer (pH 10.2 at 106 F) | 180 s |
| Stop bath (pH < 1.0) | 30 s |
| Wash | 30 s |
| Bleach (pH 6.5) | 180 s |
| Wash | 60 s |
| Fix (pH 6.5) | 120 s |
| Wash | 120 s |
| Stabilizer Bath (photoflo) | 10 s |

The color developer and bleach solutions employed in this experiment had the following compositions:

| Color Developer: | |
|---|---|
| Water | 850 ml |
| Anti-calcium agent | 2 ml |
| Sodium Sulate (desicated) | 2 ml |
| Anti-foggant | 0.22 g |
| Sodium Bromide (anhydrous) | 1.20 g |
| Sodium Carbonate (anhydrous) | 25.6 g |
| Sodium Bicarbonate | 2.7 g |
| developing agent, 4-amino-3-methyl-N-ethyl-N-β-(methane sulfonamido)-ethylaniline sulfate | 4.0 g |
| diluted to 1.0 l with water; showing a pH of 10.2 +/− 0.02 at 27° C. | |
| **Bleach:** | |
| Water | 900 ml |
| Potassium Ferricyanide | 40 g |
| Sodium Bromide | 25 g |
| diluted to 1.0 l with water; showing a pH of 6.5 +/− 0.5 at 27° C. | |

The image densities at the various levels of exposure were measured, and the gamma (γ), calculated. Granularity (σ) measurements were made according to procedures described in the SPSE Handbook of Photographic Science and Engineering, edited by W. Thomas, Jr., 1973, pp. 934–939. The measurements at step 6 (midscale) were then normalized by dividing by the incremental gamma (γ) and multiplying by 1000 to obtain gamma-normalized granularity (σ/γ). The results are presented in Table I.

To interpret the data in Table I, it should be understood that since the absolute measured granularity of a film element is directly dependent on both the dye density and the contrast at the exposure point where the measurement is taken (see James, The Theory of the Photographic Process 4th, Chapter 23), the raw granularities of two different film elements exhibiting different densities and contrasts for the same exposure cannot be compared directly. The effect of the changes in density and contrast on granularity must be taken into account in order to make a fair comparison of the 'graininess', or 'noise level' of the different film elements. A common method of making this comparison is to use a gramma-normalized granularity ($\sigma/\gamma$). This analysis, however, may lead to errors, particularly for elements having substantially different gammas, as the changes in granularity resulting from gamma changes may not be the same for all materials.

A different method to compare different film elements, and the one that is used in this example, is to vary the chemistry in the elements so that at equal exposures, the densities and gamma are as close as possible between the two elements. This will allow for a fair comparison of $\sigma/\gamma$, and is also a better model of the ultimate use of the film elements, which in practice are adjusted to some constant desired gamma.

There are many methods that can be used to adjust the chemistry in film elements so as to match the sensitometry (density and contrast performance). In the present example, introduction of a coupler (B) compound according to the invention increased density and contrast. In order to match the sensitometry of elements with and without a coupler (B) compound, the amount of dye-image-forming coupler was reduced when a coupler (B) compound was added.

TABLE I

| Example | Coating | Image-forming Coupler Level (mg/ft$_2$) | DIR Coupler Level (mg/ft$_2$) | Coupler (B) Level (mg/ft$_2$) granularity | Gamma-normalized Granularity | Reduction in gamma-normalized |
|---|---|---|---|---|---|---|
| 1 | 1A | 70 | D-1, 5.0 | — | 16.1 | — |
| | 1B | 55 | D-1, 5.0 | B-1, 5.0 | 15.8 | — |
| | Comparison | — | — | — | — | 0.3 |
| | 1C | 70 | A-1, 5.0 | — | 15.9 | — |
| | 1D | 60 | A-1, 5.0 | B-1, 5.0 | 14.2 | — |
| | Invention | — | — | — | — | 1.7 |
| | 2A | 70 | D-2, 7.0 | — | 16.5 | — |
| | 2B | 55 | D-2, 7.0 | B-1, 5.0 | 16.0 | — |
| | Comparison | — | — | — | — | 0.5 |
| | 2C | 70 | A-2, 6.0 | — | 18.6 | — |
| | 2D | 55 | A-2, 6.0 | B-1, 5.0 | 15.9 | — |
| | Invention | — | — | — | — | 2.7 |

D-2

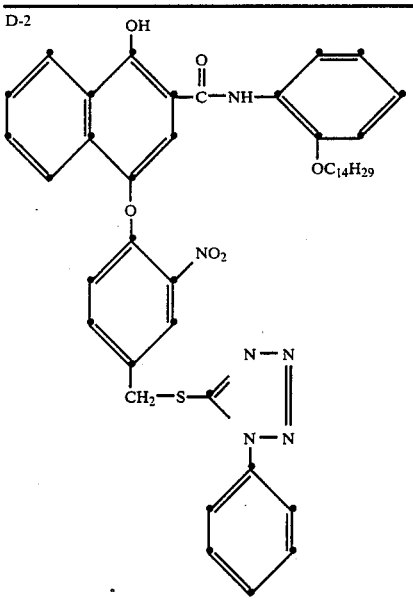

The results in Table I show that for elements having matched density and contrast performance, the coupler (B) used according to the invention yields greater reductions in gamma-normalized granularity (1.7 vs. 0.3 and 2.7 vs. 0.5) when used in combination with a DIR coupler (A) compound of formula (I) than when used in combination with other DIR couplers, such as the comparison DIR couplers D-1 or D-2.

The invention has been described in detail with particular reference to preferred embodiments thereof, but it will be understood that variations and modifications can be effected within the spirit and scope of the invention.

What is claimed is:

1. A photographic element comprising a support having thereon at least one layer comprising a photographic silver halide emulsion, in reactive association with the silver halide emulsion:

(a) a first coupler represented by the formula:

$$COUP_1—T—INH—CH_2—Q$$

wherein $COUP_1$ is a coupler moiety,

T is a timing group that is bonded to the coupler moiety at a coupling position and that is cleaved from —INH—$CH_2$—Q after it is released from the coupler moiety upon exposure and processing of the element, and INH—$CH_2$—Q is a development inhibitor moiety wherein Q is a ballasting group, and (b) a second coupler represented by the formula:

$COUP_2—(TIME)_n—S—R_1—R_2$ wherein $COUP_2$ is a coupler moiety, TIME is a timing group, n is 0 or 1, $R_1$ is a divalent linking group that does not include a heterocyclic ring attached directly to S, and $R_2$ is a water solubilizing group.

2. A photographic element according to claim 1 wherein $R_2$ is carboxy.

3. A photographic element according to claim 1 wherein the second coupler is represented by the formula:

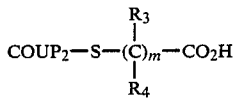

wherein m is 1 to 8, $R_3$ and $R_4$ each independently represent hydrogen or alkyl of from 1 to 4 carbon atoms, and the sum of m and the number of carbon atoms represented by both $R_3$ and $R_4$ is 1 to 8.

4. A photographic element according to claim 1 wherein the coupler moiety of the second coupler is represented by the formula:

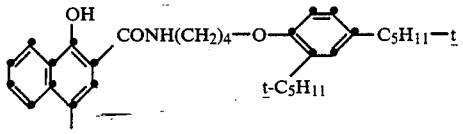

5. A photographic element according to claim 1 wherein $—R_1—R_2$ is selected from the group consisting of $—CH_2—CH_2—CO_2H$, $—CH_2—CH_2—O—CH_2—CH_2—OH$,

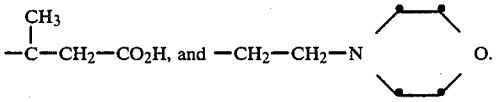

6. A photographic element according to claim 1 wherein —TIME— is selected from the group consisting of:

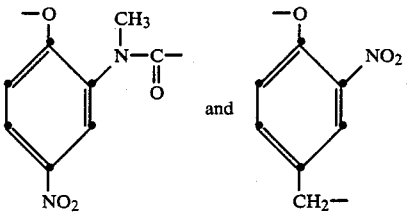

7. A photographic element according to claim 1 wherein the second coupler is represented by the formula:

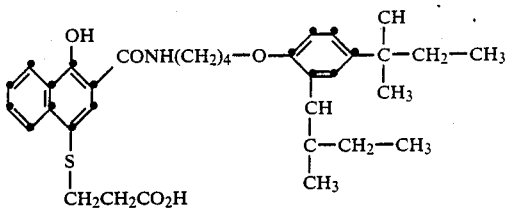

8. A photographic element according to any of claims 1–7 wherein Q: (i) has a molecular weight greater than 70 mass units, (ii) contains no ionized groups at processing pH, (iii) does not substantially decompose during processing, and (iv) comprises at least one —C— or —C=N— double bond.

9. A photographic element according to any of claims 1–7 wherein —Q is aryl or substituted aryl of from 6 to 20 carbon atoms.

10. A photographic element according to any of claims 1–7 wherein $COUP_1$— is represented by the formula:

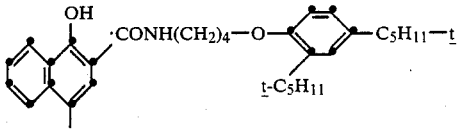

11. A photographic element according to any of claims 1–7 wherein T is a timing group bonded to INH through a substituted or unsubstituted methylene group contained in T and bonded to $COUP_1$ through an O, S, or N atom contained in T, and INH is a development inhibitor moiety, and wherein the T—INH group is able to undergo electron transfer along a conjugated system therein to cleave INH after T—INH is cleaved from $COUP_1$.

12. A photographic element according to claim 11 wherein —T— is represented by the formula:

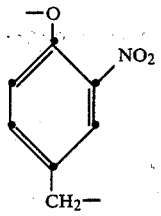

13. A photographic element according to any of claims 1–7 wherein $—INH—CH_2—Q$ is represented by the formula:

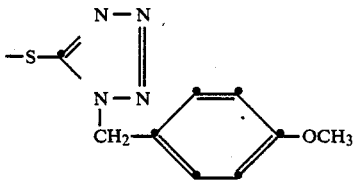

14. A photographic element according to any of claims 1–7, further comprising, in reactive association with the silver halide, a third coupler that is a dye-forming coupler.

* * * * *